US006350987B1

(12) United States Patent
Northrup et al.

(10) Patent No.: US 6,350,987 B1
(45) Date of Patent: Feb. 26, 2002

(54) ENZYMATIC REACTION MECHANISMS BY QUENCHED-FLOW MASS SPECTROMETRY

(76) Inventors: Dexter B. Northrup, 1210 Bowdoin Rd., Madison, WI (US) 53705; Frank B. Simpson, 5941 Hwy. 113, Waunakee, WI (US) 53597

( * ) Notice: Subject to any disclaimer, the term of this patent is extended or adjusted under 35 U.S.C. 154(b) by 0 days.

(21) Appl. No.: 09/281,336

(22) Filed: Mar. 30, 1999

Related U.S. Application Data

(60) Provisional application No. 60/080,214, filed on Mar. 31, 1998.

(51) Int. Cl.[7] ..... H01J 49/04
(52) U.S. Cl. ..... 250/282; 250/288
(58) Field of Search ..... 250/282, 288

(56) References Cited

U.S. PATENT DOCUMENTS 6,054,709 A * 4/2000 Douglas et al. ..... 250/282

OTHER PUBLICATIONS

Lee, Muck, Henion & Covey; Real–Time Monitoring by continuous Introduction Ion–Spray Tandem Mass Spectrometry, 1989.
Li & Henion; Observation of Nonco Valent Enzyme–Substrate and Enzyme–Product Complexes by Ion–Spray Mass Spectrometry 1991.
Ganem & Henion; Detecting Noncovalent Complexes of Biological Marcomolecules, 1993.
Hsieh Tong, Wachs, Ganem & Henion; Kinetic Monitoring of Enzymatic Reactions in Real Time by Quantitative . . . 1995.
Sam, Tang & Peisach; Electrospay Mass Spectrometry of Iron Bleomycin 1994.
Sam, Tang, Magliozzo & Peisach; Electrospray Mass Spectrometry of Iron Bleomycin II 1995.

* cited by examiner

*Primary Examiner*—Jack Berman
(74) *Attorney, Agent, or Firm*—Donald J. Ersler

(57) ABSTRACT

There are several preferred methods for analyzing chemical and biochemical reactions with an electrospray mass spectrometer. The hardware required for analyzing enzymes includes, an electrospray ionization inlet, mass spectrometer, at least two syringes, at least one pushing ram, a mixing device, and monitoring equipment. The pushing ram includes a platen for pushing the plunger of at least one syringe. The platen is preferably actuated by rotation of a stepper motor, or the like. The rotation of the stepper motor is preferably microprocessor controlled. The output of each syringe is connected to the mixing device which mixes the reactant in each syringe and starts a chemical reaction. The output of the mixing device is connected to the input orifice of the electrospray ionization inlet with a reaction tube having a specific volume. The mixed reaction solution is input through the input orifice of the electrospray ionization inlet. The volatile molecules of the solution are removed when the mixed reaction solution enters a chamber filled with a warm, flowing dry gas inside the electrospray ionization inlet. The mass spectrometer is adjusted to collect the ions of interest which are then recorded with the monitoring equipment. A spectrophotometer may also be used for analyzing the mixed solution.

7 Claims, 3 Drawing Sheets

ENZYMATIC REACTION MECHANISMS BY QUENCHED-FLOW MASS SPECTROMETRY

CROSS-REFERENCES TO RELATED APPLICATIONS

This is a utility patent application of Ser. No. 60/080,214 filed on Mar. 31, 1999.

BACKGROUND OF THE INVENTION

1. Field of the Invention

The present invention relates generally to mass spectrometry and more specifically to analysis of enzyme-catalyzed chemical reactions, pathways, and reaction mechanisms by quenched-flow mass spectrometry which allows chemical and biochemical reactions to be analyzed at different stages throughout the reaction.

2. Discussion of the Prior Art

Until recently, it was not possible to analyze enzymes or enzyme solutions using mass spectrometry. No method was available to introduce a nonvolatile protein molecule into the gas phase, as is necessary for mass spectral analysis. If a protein molecule dissolved in water was introduced into a mass spectrometer the water would short out and destroy the ionizing filament.

With the recent advent of techniques such as fast atom bombardment (FAB), matrix assisted laser desorption ionization (MALDI), and electrospray ionization (ESI), it now is possible to transfer nonvolatile, ionized protein molecules into the gas phase. The recently developed techniques of flow FAB and electrospray ionization additionally have the advantage of permitting introduction of solutions into the mass spectrometer, thus enabling mass spectral analysis of dissolved enzymes. The gentle ionization conditions of electrospray ionization mass spectrometry make it particularly advantageous for analysis of enzyme reaction mixtures, because covalent and noncovalent enzyme ligand interactions often remain intact. However, the mere fact that the electrospray ionization inlet exists doesn't provide a method for analyzing chemical and biochemical reactions.

Accordingly, there is a clearly felt need in the art for enzymatic reaction mechanisms by quenched-flow mass spectrometry which allows monitoring the progress of chemical, biochemical and enzymatic reactions at a particular time during the reaction.

SUMMARY OF THE INVENTION

The primary objective of the present invention is to provide enzymatic reaction mechanisms by quenched-flow mass spectrometry which allows monitoring the progress of chemical, biochemical and enzymatic reactions at a particular time during the reaction.

According to the present invention, there are several preferred methods for analyzing enzymes with an electrospray mass spectrometer. The hardware required for analyzing enzyme reactions includes, a mass spectrometer, an electrospray ionization inlet, at least two syringes, at least one pushing ram, at least one mixing device, and monitoring equipment. The pushing ram includes a platen for pushing the plunger of at least one syringe. The platen is precisely actuated preferably by a stepper motor, but could be actuated by a DC motor with optical encoder, a motor driven clutch mechanism, a hydraulic system, or the like. The rotation of the stepper motor is preferably microprocessor controlled. The output of each syringe is connected to the mixing device which mixes the reactant contained in each syringe and initiates a chemical reaction immediately, or immediately subsequent to the point of mixing.

The output of the mixing device is connected to the electrospray ionization inlet with a reaction tube having a specific volume. The output of the electrospray ionization inlet is connected to the inlet of the mass spectrometer. The mixed reaction solution is input through the electrospray ionization inlet. The volatile molecules of the solution are removed in a chamber within the electrospray ionization inlet filled with a warm flowing drying gas. The ions generated by the electrospray ionization inlet are transferred through a second orifice or skimmer into the vacuum of the mass spectrometer where they are subjected to mass analysis. The electrospray mass spectrometer is adjusted to collect the ions of interest, and the resulting current is then recorded with the monitoring equipment. A spectrophotometer may also be used for analyzing the mixed solution.

Accordingly, it is an object of the present invention to provide enzymatic and nonenzymatic reaction mechanisms by quenched-flow mass spectrometry which allows the reaction to be stopped at a particular time during the reaction.

It is a further object of the present invention to provide enzymatic and nonenzymatic reaction mechanisms by quenched-flow mass spectrometry which utilizes an electrospray mass spectrometer to analyze an intermediate sample produced at some time during the reaction.

It is yet a further object of the present invention to analyze, obtain, and to quantify a sufficient number of mass analyses at a sufficient number of particular times during a reaction to enable construction of progress curves for every charged, nonvolatile reaction species of unique mass/charge ratio and interest.

Finally, it is another object of the present invention to provide enzymatic and nonenzymatic reaction mechanisms by quenched-flow mass spectrometry which allows a user to combine two existing pieces of equipment to obtain an intermediate sample which was not possible with prior art methods.

These and additional objects, advantages, features and benefits of the present invention will become apparent from the following specification.

DETAILED DESCRIPTION OF THE PREFERRED EMBODIMENTS

Figure 1:
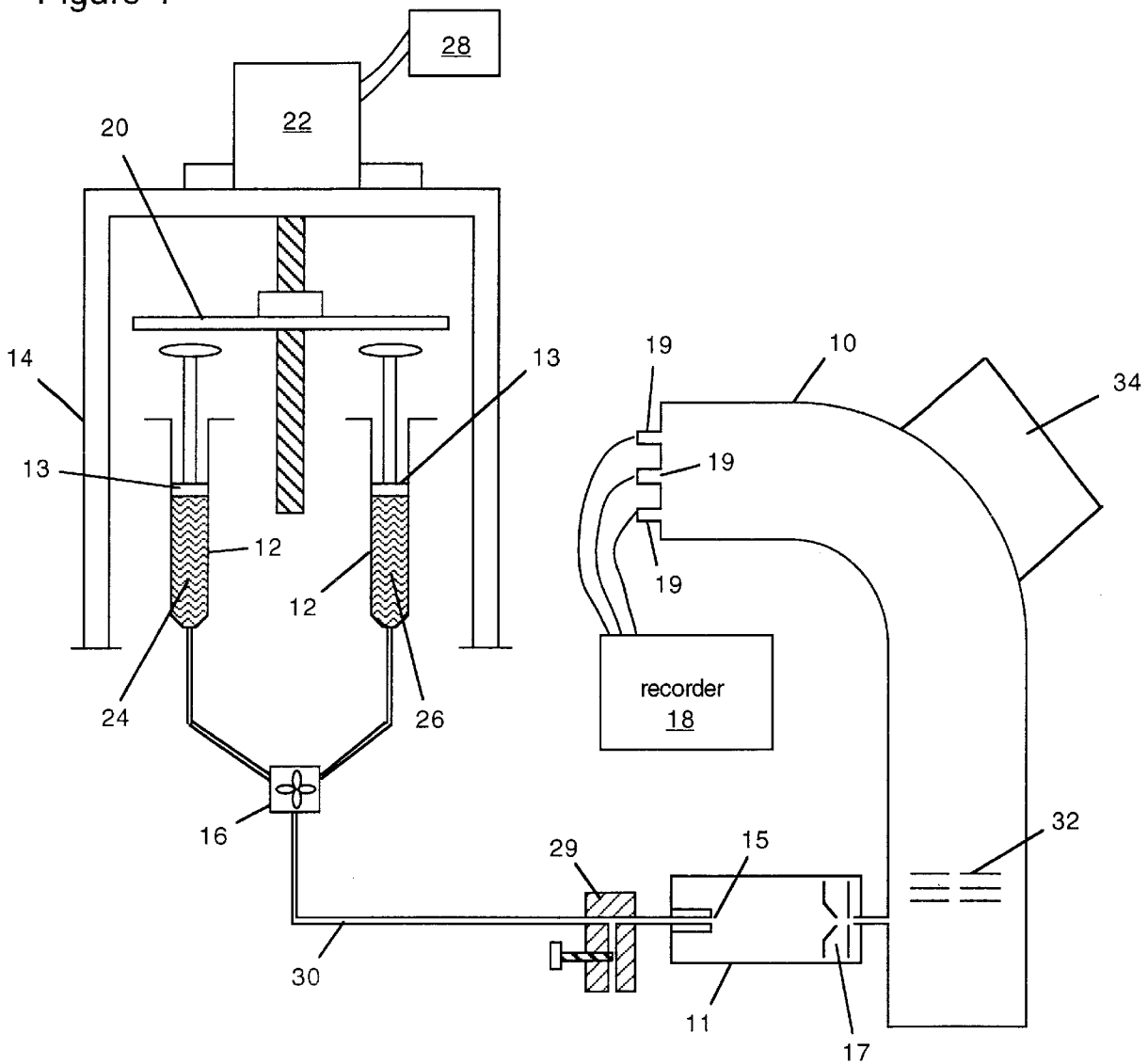
FIG. 1 is a schematic view of the hardware required for analyzing enzymatic, chemical, or biochemical reactions in accordance with the present invention.

With reference now to the drawings, and particularly to FIG. 1, there is shown a schematic diagram of the hardware required for analyzing enzymatic, chemical, or biochemical reactions at a specific time during the period of a reaction. The hardware required for analyzing enzyme reactions includes, an electrospray ionization inlet 11, a mass spectrometer 10, at least two syringes 12, at least one pushing ram 14, a mixing device 16, and monitoring equipment 18. The pushing ram 14 includes a platen 20 for pushing the plunger 13 of at least one syringe 12. The platen 20 is preferably actuated by a stepper motor 22, or the like. The rotation of the stepper motor 22 is preferably controlled by a computer or microprocessor based device 28. The pushing ram 14 may be purchased from any one of several companies.

The output of each syringe 12 is connected to the mixing device 16 which mixes the reactant in each syringe 12 and starts a chemical reaction. With present mixing equipment, the time period for mixing is 3 milliseconds or less. However, mixing times of less than 10 microseconds have been reported with mixers micromachined on silicon wafers. The duration of any chemical reaction to be measured by any of the preferred methods must be greater than the mixing time period. The output of the mixing device 16 is connected to the input orifice 15 of the electrospray ionization inlet 11 with a reaction tube 30 of a specific volume. The volume of the reaction tube 30 is critical in monitoring of the progress of the chemical reaction. The volume of the reaction tube 30 is correlated with the velocity of the platen 20 actuation and the diameter of the syringes 12. Some applications may use a splitter 29 or a combination of microsplitters. The splitter 29 may be added before the electrospray ionization inlet 11 to divert some of the flow from going into the input orifice 15. Addition of splitters may be necessary because flow rates of some rapid-reaction methods exceed 1 ml per second, whereas flow rates of electrospray ionization inlet methods range from 0.02 microliters per minute to 100 microliters per minute. It also is possible to use a fine-bore capillary of 0.01 centimeter internal diameter or less to obtain adequate time resolution at flow rates compatible with electrospray ionization inlet. The velocity of the platen 20, or the volume of the reaction tube 30 may be varied to generate different time periods of reaction between the point of mixing of reactants and the point of introduction of the mixed reaction solution into the input orifice 15 of the electrospray ionization inlet chamber 11 of the mass spectrometer 10. The character of fluid flow through the mixer or the reaction tube 30 may be laminar or turbulent.

The mixed reaction solution is input through the input orifice 15 of the electrospray ionization inlet 11. The input orifice is maintained at an electrical potential of a few kilovolts relative to the input skimmer of the mass spectrometer 17. The volatile molecules of the solution are removed in a chamber inside the electrospray ionization inlet 11 which is filled with a warm, flowing drying gas. The nonvolatile molecules remain. The ions generated by the electrospray ionization inlet 11 are transferred through a second orifice or skimmer 17 into the vacuum of the mass spectrometer 10 where they are subjected to mass analysis. The ions present after electrospray ionization pass through the skimmer 17 into the vacuum of the mass spectrometer 10 where they are subjected to analysis according to their mass/charge ratio. The voltage level across the accelerator plates 32 and/or the intensity of the magnet 34 are adjusted to impinge the ions of interest on the collectors 19 to generate currents which are then recorded with the monitoring equipment 18. The mass spectrometer 10 is preferably a magnetic sector design, other mass spectrometer design types may also be interfaced with the electrospray ionization inlet 11. The other mass spectrometer design types include quadrapole, time-of-flight, ion trap, and Fourier transform.

Figure 3:
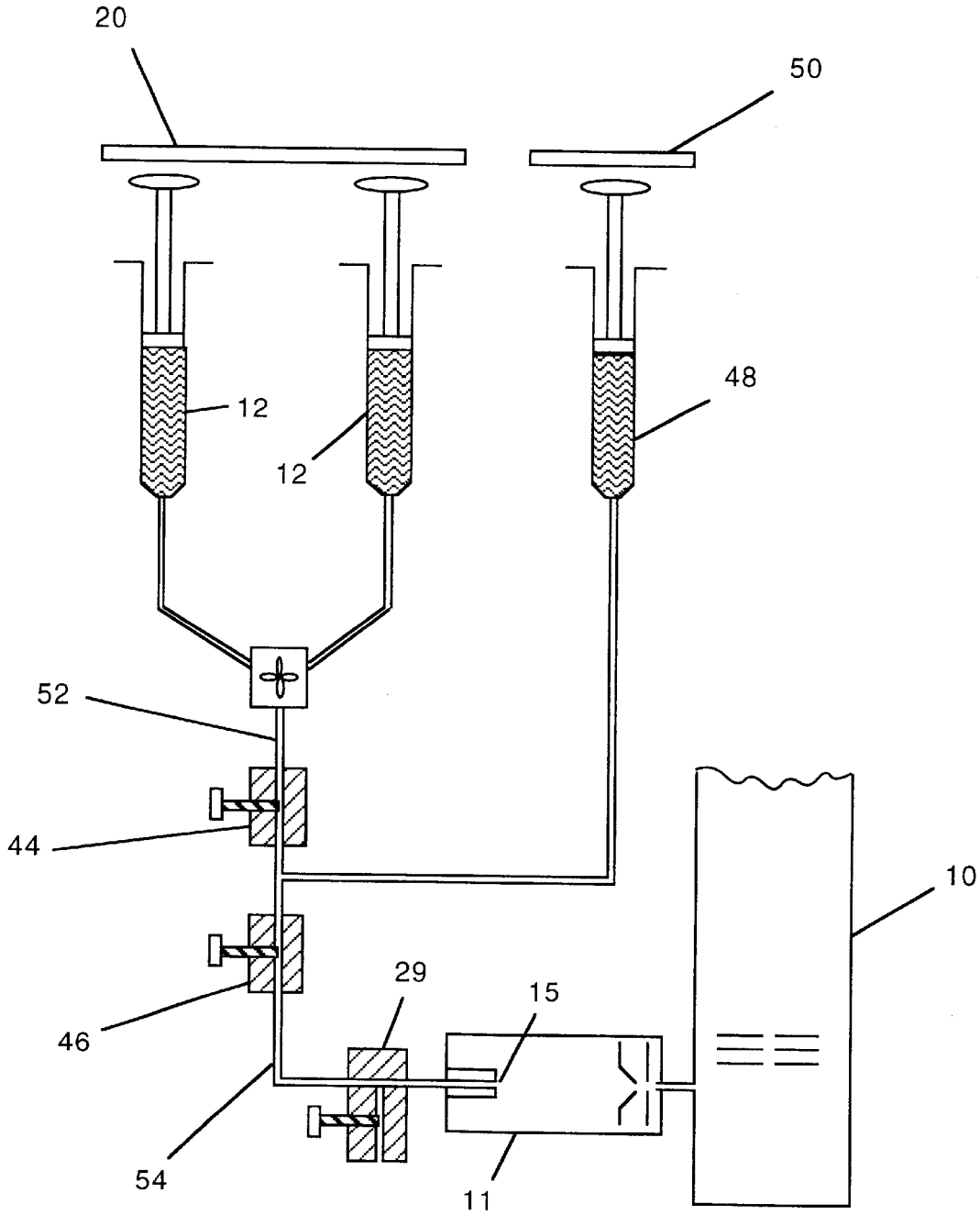
FIG. 3 is a schematic view of an alternative hardware configuration for analyzing enzymatic, chemical, or biochemical reactions with the stopped-flow method in accordance with the present invention.

Another preferred hardware configuration is disclosed in FIG. 3. Electrospray mass spectrometry may be interfaced with the stopped-flow method by including a first valve 44, a second valve 46, and a third syringe 48. With the first valve 44 open and the second valve 46 closed, the platen 20 is pushed rapidly for a short period of time to dispense a sufficient quantity of reaction mixture through the mixer and through a small volume filling line 52 into a reactor cell. The reactor cell may be a third syringe 48 or a stirred reactor vessel. It is necessary to fill the reactor vessel quickly so that the age of the mixed reaction solution is as uniform as possible. An exit tube 54 leads from the second valve 46 to the inlet orifice of the electrospray ionization inlet 11. With the first valve 44 closed and the second valve 46 open, the mixed reaction solution is dispensed from the third syringe 48 by a second platen 50 through the exit tube 54 and enters the inlet orifice 15 of the electrospray ionization inlet 11 at a predetermined rate of flow prior to mass spectral analysis to monitor the progress of the reaction.

The following reaction is given by way of example and not by way of limitation. One of the syringes contains a solution of the enzyme hexokinase 24 and the other syringe contains a solution of glucose and adenosine triphosphate 26. At time t=zero, the hexokinase 24 is mixed with the glucose/adenosine triphosphate 26 to initiate the reaction. The hexokinase 24 acts as a catalyst to form the products of glucose-6-phosphate and adenosine diphosphate. The reaction of the hexokinase 24, the glucose, and the adenosine triphosphate may be measured at any time during the reaction time period. The only exception is that the time period must be greater than the duration of mixing.

Adding another syringe 12 and using more than one pushing ram 20, with or without inclusion of an additional mixer 16, allows a further reactant(s) to be added at a particular time during the primary reaction between two or more reactants. The addition of further reactants during the primary reaction period allows an innumerable variety of complex intermediate compounds to be formed and analyzed at a particular time during their reaction periods.

There are several preferred methods of monitoring the chemical, biochemical and enzymatic reactions at a particular time during the reaction utilizing the mass spectrometer 10. In all the preferred methods the correlation between the speed of the pushing ram 14, the diameter of the syringes 12, and the volume of the reaction tube 30 is critical. With reference to FIG. 1, the time necessary for the solution to travel from the mixing device 16 to the electrospray ionization inlet 11 determines at what time during the reaction the intermediate samples are analyzed.

A first preferred method of precisely generating a time base for reactions is termed continuous-flow and utilizes a continuous motion of the pushing ram 20. Continuous-flow analysis may be of two types. In the first type, the platen 20 is pushed at the same constant pumping speed during observation of each time point of the reaction. The period of reaction is varied by changing the volume of the reaction tube 30 joining the mixer with the electrospray inlet orifice. The rate of flow through each reaction tube 20 of specific volume is maintained constant until a sufficient quantity of reaction mixture has passed into the mass spectrometer 10, or a sufficient period of flow has elapsed, to enable the necessary mass analysis for that particular time point. In the second type of analysis by continuous-flow, the volume of the reaction line 30 is maintained constant for each analysis, but the pumping speed is varied, preferably by varying the speed of the platen 20. The selected speeds of the platen 20 may be maintained constant to observe a single time point, or the pumping speed may be accelerated or decelerated at a known rate, to analyze a reaction at a continuous range of reaction times.

A second preferred method of monitoring reactions utilizes a push-pause-push motion for the pushing ram 14. The platen 20 is actuated for a set period to expel some volume of reactants from the syringes. The reaction tube 30 has enough volume to contain the mixed reactants. The platen 20 is then stopped for a predetermined period of time. The platen 20 is then actuated until the mixed reactants have been expelled from the reaction tube 30 into the electrospray ionization inlet 11. A second platen which pushes an alternative syringe and operates at a different starting time than the platen 20 may also be used. The sum of the flow time period plus the pause time period corresponds to a particular timepoint during the reaction period that needs to be analyzed. The push-pause-push method of sample introduction may be augmented by an additional syringe and platen to maintain constant flow to the electrospray inlet during the pause.

The following time periods are given by way of example and not by way of limitation. The reaction is to be monitored 500 milliseconds into the reaction. It takes 25 milliseconds of flow to fill the reaction tube 30, therefore the pause time is 475 milliseconds before the second push is initiated. The duration of the second push must be at least 25 milliseconds to expel the reaction mixture generated by the first push into the electrospray ionization inlet 11.

Figure 2:
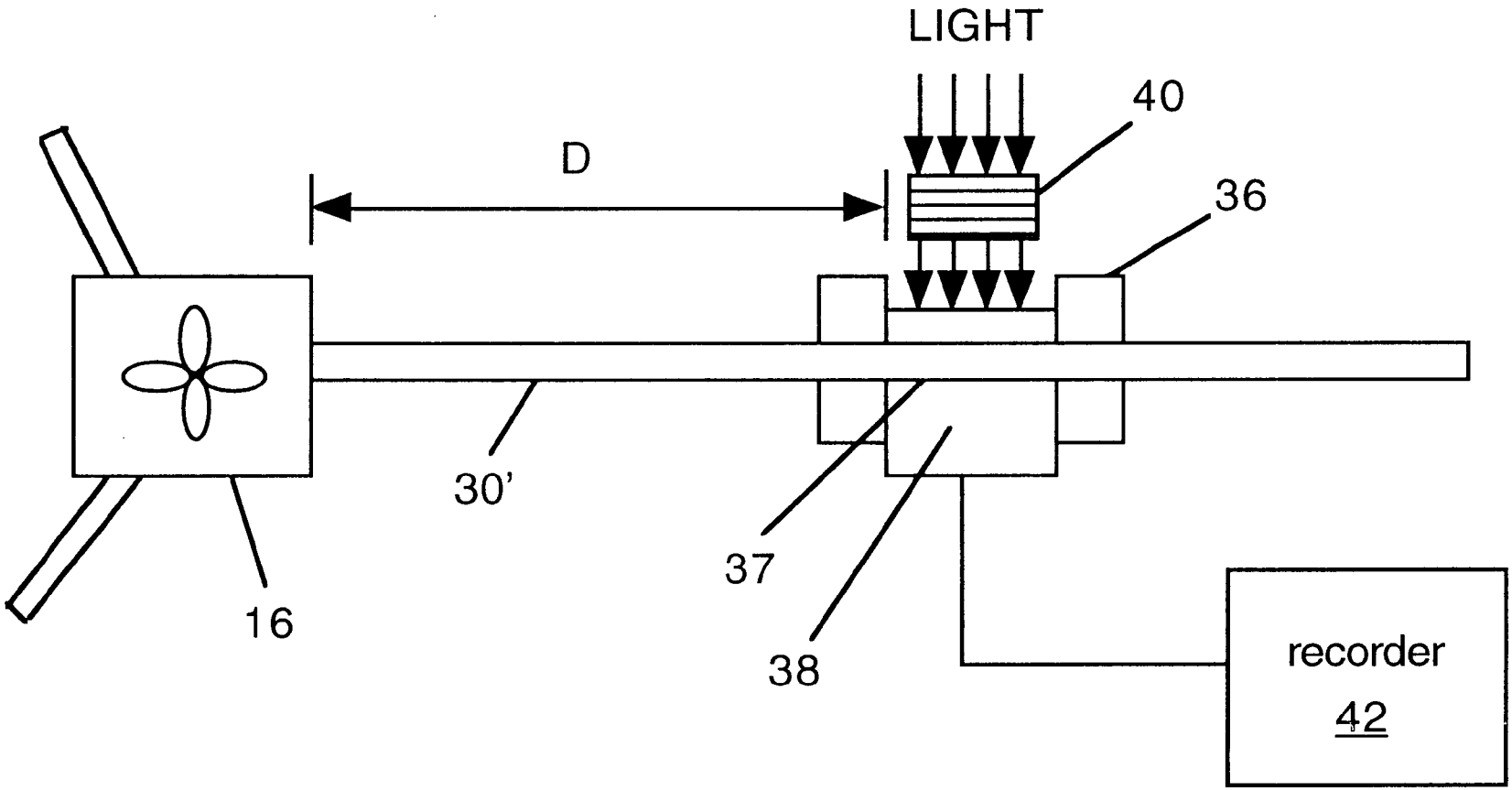
FIG. 2 is a schematic view utilizing a spectrophotometer in conjunction with an electrospray mass spectrometer for analyzing enzymatic, chemical, or biochemical reactions in accordance with the present invention.

A third preferred method of monitoring reactions is called stopped-flow. This method preferably is coupled to a spectrophotometer. The reactants in the syringes 12 are mixed and caused to flow at a predetermined rate by the pushing ram 14 for a predetermined period of time. With reference to FIG. 2, the volume of the reaction tube 30' is such that the pushing ram 14 causes the solution to reach the transparent observation cell 37 within the spectrophotometer 36. The length D of the reaction tube 30' is chosen such that the mixed solution arrives at the observation cell 37 at a particular time during the reaction; usually as soon as is possible after mixing. The platen 20 is stopped immediately once the mixed reaction solution has tilled the observation cell 37. The spectrophotometer 36 utilizes visible, ultraviolet, or infrared light which is passed through a prism 40 or a diffraction grating to divide the light into individual colors. Presence of certain substances in the transparent observation cell 37 will absorb different portions of the spectrum. A light detector 38 will allow monitoring equipment 42 to record the portions of the spectrum which do pass through the mixed solution.

The stopped-flow method may be interfaced with an electrospray inlet mass spectrometer (an electrospray ionization inlet interfaced with some type of mass spectrometer) by rapidly filling a reaction vessel or a syringe with mixed reactants to produce a mixed reaction solution that is as uniform in age as possible. Aliquots of this mixed reaction solution then can be transferred, preferably continuously through a tube, from the reaction vessel or syringe to the input orifice of the electrospray inlet mass spectrometer to monitor the progress of the reaction.

A fourth preferred method called quenched-flow or rapid-quench is used to terminate reactions. Rapid-quench is accomplished by rapidly freezing the mixed reaction solution, rapidly mixing the mixed reaction solution with a second solution which quickly stops the reaction, or injecting the mixed solution directly into the electrospray ionization inlet 11. If the mixed solution is freezed or a second solution is added to the mixed solution, the mixed solution may be analyzed at a later date. Rapid-quench by electrospray mass spectrometry enables mass analysis of a mixed reaction solution immediately following the electrospray quench. The quench-flow method is accomplished after causing the reactants in the syringes 12 to flow at a predetermined rate by the pushing ram 14 for a predetermined period of time by either the continuous flow or the push-pause-push methods.

The volume of the reaction tube 30 is such that the pushing ram 14 causes the solution to reach the electrospray ionization inlet 11. The length of the reaction tube 30 is chosen such that the mixed solution arrives at the electrospray mass spectrometer at a particular time during the reaction. Once the mixed solution passes through the input orifice 15 and into the chamber of the electrospray ionization inlet 11, the reaction quickly stops. Mass analysis of any intermediate compounds may be performed immediately thereafter within the mass spectrometer 10. Electrospray ionization similarly may be employed to quench a mixed reaction solution entering from a stopped-flow or a batch reactor vessel to enable immediate analysis by mass spectrometry.

If the cone voltage of the input orifice 15 of the electrospray ionization inlet 11 is increased, noncovalent enzyme-ligand complexes may be disrupted by the rapid electrospray quench, thus permitting subsequent mass analysis and identification of enzyme-bound reaction intermediates. It is also possible to perform tandem mass spectrometry ($MS^n$) by connecting mass spectrometers in series with each other in time and/or in space. An output orifice near the collectors 19 of a first mass spectrometer is connected to the inlet orifice of a successive mass spectrometer. A number of mass spectrometers in series allows collision-induced dissociation to dissociate complexes or to fragment molecules and to thereby effect more rigorous mass analysis and more positive identification.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A method for analyzing the composition of a mixed solution comprising the steps of:

(a) causing a predetermined volume of at least two reactants to flow;

(b) mixing said at least two reactants;

(c) providing a reaction tube with a volume equal to the predetermined volumes of both reactants;

(d) pausing for a period of time which corresponds to particular time during the reaction that needs to be analyzed; and (e) causing the volume of mixed reactants in said reaction tube to be expelled into an electrospray ionization inlet which has an output connected to an inlet of a mass spectrometer.

2. The method for analyzing the composition of a mixed solution of claim 1, further comprising the steps of:

(a) providing another reactant which has a flow that starts sometime after said at least two reactants.

3. The method for analyzing the composition of a mixed solution of claim 1, further comprising the steps of:

(a) connecting the output orifice of a first mass spectrometer to an inlet orifice of a second mass spectrometer to perform tandem mass spectrometry analysis in space or in time.

4. A method for analyzing the composition of a mixed solution comprising the steps of:

(a) causing predetermined volumes of at least two reactant solutions to flow simultaneously and continuously, each of said at least two reactant solutions flowing at a known rate;

(b) flowing said at least two reactant solutions through a small volume mixing cell to generate rapid mixing, said rapid mixing producing a mixed reactant solution;

(c) flowing said mixed reactant solution continuously and rapidly from said small volume mixing cell through a small volume filing tube;

(d) flowing said mixed reactant solution continuously from said small volume filling tube rapidly into a variable volume reaction chamber, said variable volume reaction chamber having sufficient volume to retain said mixed reactant solution;

(e) filling rapidly said variable volume reaction chamber with a predetermined volume of said mixed reactant solution;

(f) stopping the flow of mixed reactant solution into said variable volume reactant chamber when thereof is filled with said predetermined volume of mixed reactant solution;

(g) maintaining said mixed reactant solution in said variable volume reaction chamber for a period of time which corresponds to a particular reaction time point after which the reaction needs to be analyzed;

(h) providing a sampling tube which connects an output of said variable volume reactant chamber to an inlet of an electrospray ionization source;

(i) discharging an aliquot of said mixed reactant solution continuously at a known flow rate from said variable volume reaction chamber through said sampling tube into said electrospray ionization source for the duration of a known sampling interval; and (j) passing ions generated by said electrospray ionization source into an inlet of a mass spectrometer.

5. The method for analyzing the composition of a mixed solution of claim 4, further comprising the steps of:

(i) connecting the output orifice of a first mass spectrometer to an inlet orifice of a second mass spectrometer to perform tandem mass spectrometry analysis in space or in time.

6. The method for analyzing the composition of a mixed solution of claim 4 wherein:

(k) monitoring an output of said mass spectrometer.

7. The method for analyzing the composition of a mixed solution of claim 4 wherein:

(l) repeating steps (g) through (k) as often as deemed necessary.

* * * * *